US005405493A

United States Patent [19]

Goad

[11] Patent Number: 5,405,493

[45] Date of Patent: Apr. 11, 1995

[54] METHOD OF ETCHING ALUMINUM FOIL

[75] Inventor: David Goad, Barrington, Ill.

[73] Assignee: KDK Corporation, Ibaraki, Japan

[21] Appl. No.: 187,085

[22] Filed: Jan. 26, 1994

[51] Int. Cl.[6] ..... B44C 1/22; C23F 1/00

[52] U.S. Cl. ..... 156/651; 156/656; 156/659.1; 156/665; 156/904; 204/129.35; 204/129.65; 428/601; 428/612

[58] Field of Search ..... 156/651, 656, 665, 659.1, 156/904; 252/79.2, 79.3, 79.4; 204/129.1, 129.35, 129.4, 129.7, 129.65, 141.5, 280; 427/79, 80, 81, 102, 256, 272; 428/601, 612

[56] References Cited

U.S. PATENT DOCUMENTS

| | | | |
|---|---|---|---|
| 3,249,523 | 5/1966 | Post et al. | 156/665 X |
| 4,437,955 | 3/1984 | Shaffer | 204/129.4 |
| 4,676,879 | 6/1987 | Salvadori | 204/129.75 |

FOREIGN PATENT DOCUMENTS

| | | |
|---|---|---|
| 2758155A1 | 6/1979 | Germany . |
| 2011716 | 7/1979 | United Kingdom . |

OTHER PUBLICATIONS

Isoyama, et al., *Chemical Abstracts,* vol. 103, 1985; p. 583; 103:204566u, "Etching aluminum foils for electrolytic capacitor electrodes".

Fujihira, et al., *Chemical Abstracts,* vol. 107, 1987; p. 579; 107:31949y, "Manufacture of aluminum electrode materials for electrolytic capacitors".

Ootsuka, et al., *Chemical Abstracts,* vol. 109, 1988; 109:84557c, "Preparation of aluminum electrode material for electrolytic capacitor".

Otsuka, et al., *Chemical Abstracts,* vol. 110, 1989; p. 783; 110:106582w, "Fabrication of an aluminum electrode material for electrolytic capacitors with high electrostatic capacitance".

Tsuchiya, et al., *Chemical Abstracts,* vol. 112, 1990; page 774; 112:228258g, "Manufacture of cathode foil for electrolytic capacitors by using alloy coating".

Matsuda, et al., *Chemical Abstracts,* vol. 114, 1991; pp. 789–790; 114:73672c, "Manufacture of electrode foils for electrolytic capacitors".

Yokoyama, et al., *Chemical Abstracts,* vol. 114, 1991; p. 861; 114:198072p, "Manufacture of aluminum electrodes for electrolytic capacitors".

*Primary Examiner*—William Powell

*Attorney, Agent, or Firm*—Marshall, O'Toole, Gerstein, Murray & Borun

[57] ABSTRACT

A method of etching increases the surface area of a metal foil by creating uniformly distributed etch tunnels. The foil is pretreated by depositing a discontinuous surface layer of metal that is cathodic to the foil, followed by chemically etching the foil to remove a portion of the deposited metal. Finally, the foil is electrochemically etched to create the etch tunnels.

25 Claims, No Drawings

METHOD OF ETCHING ALUMINUM FOIL

FIELD OF THE INVENTION

This invention relates to the electrochemical etching of aluminum foil. More particularly, this invention relates to a method of electrochemical etching that increases the surface area of an aluminum foil by creating randomly distributed etch tunnels. After forming, the resulting etched aluminum foil will have an increased capacitance.

BACKGROUND OF THE INVENTION AND PRIOR ART

One purpose of electrochemically etching is to increase the surface area of a metal foil. Since the capacitance of an electrolytic capacitor increases with the surface area of its electrodes, which are often aluminum foils, increasing the surface area of an aluminum foil is useful to increase the capacitance of an electrolytic capacitor. One type of electrochemical etching process increases surface area by removing portions of the aluminum foil to create etch tunnels. Typically, etch tunnels are created by first making the aluminum foil anodic in an electrolyte, and then passing an electric current between the anode and cathode.

Metal foil is commonly pretreated (treated prior to etching) in order to maximize the increase in surface area and improve the distribution of etch tunnels during the subsequent etching steps. A pretreatment can be one of three types: mechanical, chemical, or electrochemical. A mechanical pretreatment strokes the surface of the metal foil with a high speed rotating metal brush to remove a surface layer and uniformly texture the surface of the foil. This type of mechanical pretreatment is an old practice in the art.

A chemical pretreatment removes residual processing oils from the surface of the metal foil and dissolves surface oxides, or replaces the surface oxides with a new surface film. Commercial cleansing agents, acid solutions, or alkaline solutions are commonly used to remove surface oils and/or dissolve surface oxides. An example of a method to replace the surface oxide with a new surface film is disclosed in Japanese Patent No. 60,163,426 [85,163,426] (CA 103:204566u), which teaches the use of a pretreatment of chromic acid prior to electrochemically etching aluminum foil. This chemical pretreatment changes a film on the surface of the foil from aluminum oxide to a mixture of aluminum oxide and chromic oxide.

An electrochemical pretreatment removes a relatively small amount of the surface metal during an initial electrochemical etch step, when compared to the amount of surface metal removed during the subsequent primary electrochemical etch step. U.S. Pat. Nos. 4,437,955 and 4,676,879 show examples of electrochemical methods of pretreatment.

Several issued patents disclose methods of physically depositing metal onto metal foils in order to enhance the resulting capacitance of the foil. Japanese Patent No. 63,100,711 [88,100,711] (CA 109:84667c) discloses the chemical vapor deposition of titanium onto a previously electrochemically etched aluminum foil. Japanese Patent No. 63,255,910 [88,255,910] (CA 110:106582w) discloses multiple layers of titanium deposited by solvent evaporation onto a previously etched aluminum foil. Japanese Patent Nos. 03 06,010 [91 06,010]; 03 32,012 [91 32,012]; and 03 30,410 [91 30,410] (CA 114:198072p; CA 115(2)20506r; and CA 115 (2)2025q, respectively) disclose methods of depositing titanium, gold, and platinum onto aluminum foil by cathode arc evaporation. German Patent No. 27 58 155 teaches a method of preparing a corrosion-resistant electrolytic capacitor anode by using evaporation or sputtering methods to deposit a tantalum film onto aluminum foil. The deposited film must be continuous over the surface of the foil, i.e., greater than a monolayer in thickness, in order to provide corrosion-resistance for the underlying foil.

Two patents show pretreatment methods of depositing metal onto a surface of an aluminum foil prior to etching the foil. Japanese Patent No. 01,283,812 [89,283,812] (CA 112:228258g) teaches a method of preparing aluminum foil for cathode use in a capacitor. The foil is pretreated by surface deposition of a metal alloy film containing low corrosion-resistant and high corrosion-resistant metals, with examples of the high corrosion-resistant metal being titanium or chromium. The foil then is chemically or electrochemically etched to remove the low corrosion-resistant metal, thus increasing the surface area of the foil while leaving the high corrosion-resistant metal on the foil surface. Japanese Patent No. 02 61,039 [90 61,039] (CA 114:73672c) also teaches a method to prepare aluminum foil for use in an electrolytic capacitor. The foil is pretreated by surface deposition of a valve metal, followed by ion etching to increase the surface area of the foil. This method is limited to using a valve metal for the pretreatment deposition, and the deposited layer must be thicker than one monolayer in order to subsequently ion etch the valve-metal-coated surface.

SUMMARY OF THE INVENTION

The present invention is directed to an improved method of etching an aluminum foil that increases the surface area of the foil by creating randomly distributed etch tunnels that are also more uniform in size. The method of the invention is useful for etching aluminum foil for use in electrolytic capacitors, because the capacitance of an electrolytic capacitor increases with the surface area of the foil used as an electrode, i.e., a cathode or an anode. Because the method of the present invention uniformly increases the surface area of the electrode foil, the increase in capacitance is consistent across the total surface area of the electrode foil. While the invention is useful for electrolytic capacitors, the invention is also advantageous for any application that benefits from a metal foil having uniformly distributed etch tunnels that are also uniform in size.

The method of the present invention enhances the effectiveness of the primary electrochemical etching of an aluminum foil by utilizing one or more pretreatment steps. One embodiment of the present invention, by using only one pretreatment step, creates the etch tunnels without using a wet process of chemical etching. In a first pretreatment step, a layer of metal that is cathodic to the aluminum foil is deposited on the surface of the foil, using any method known in the art, such as thermal or electron beam evaporation, sputtering, or chemical vapor deposition. Vacuum or inert gas atmospheres should be used for some methods of metal deposition, as well known to one skilled in the art. The deposited metal should be cathodic to the aluminum foil in the electrolyte used, when subsequently electrochemically etching the foil. For example, metals that are cathodic to aluminum foil include lead, silver, gold, zinc, and tin.

The deposited layer of metal preferably should be a discontinuous layer in order to create a heterogeneous surface comprising random areas of deposited metal and random areas of bare, uncovered aluminum. Typically, methods used to deposit a thin layer of metal do not uniformly deposit the metal layer, but rather create random clusters of deposited metal on the surface of the foil. Additionally, in accordance with another important embodiment of the present invention, the pattern of deposited metal clusters may be controlled by covering or masking portions of the aluminum foil prior to and during the metal deposition pretreatment step.

In accordance with another important embodiment of the present invention, a second pretreatment step may be employed to remove portions of aluminum adjacent to the deposited metal clusters. The foil, after deposition of metal on its surface, is then subjected to the second pretreatment step comprising a chemical etching step using a relatively mild concentration of chemical etchant, such as hydrochloric, sulfuric, hydrofluoric, or fluosilicic acid. It is believed that the exposed aluminum surfaces, adjacent to the deposited metal clusters, resulting from the second pretreatment step, become preferred sites for reaction during the final electrochemical etching step.

The final step in the method of the present invention is electrochemical etching of the pretreated aluminum foil, using any electrochemical etching method known to one skilled in the art, for example, D.C., A.C. or pulse etching. It is believed that the discontinuous metal layer, deposited in the first pretreatment step, and preferably the aluminum surfaces exposed by mild chemical etching in the second pretreatment step, act as local sites for cathodic reactions during the electrochemical etching step, and thus create a substantial number of etch tunnels near the deposited metal cluster sites. If the deposited metal covers the entire surface of the aluminum foil, or if the deposited metal clusters are not widely distributed, the electrochemical etch will produce only a small number of etch tunnels that are not widely distributed.

Regardless of the actual mechanism, the etch tunnels are more widely and randomly distributed across the surface of the aluminum foil when the foil is electrochemically etched using the pretreatment steps of depositing a discontinuous metal layer that is cathodic to the aluminum foil, and mildly chemically etching the foil having the deposited metal on its surface. After forming, i.e., treating to produce a dielectric oxide coating on the surface, the capacitance of the electrochemically etched foil is higher for a foil utilizing the pretreatment steps of the present invention. The prior art would not lead one to believe that physical deposition of a discontinuous layer of a metal cathodic to an aluminum foil, followed by chemical etching, would be a useful pretreatment prior to electrochemical etching of the aluminum foil, and that such a pretreatment would promote the uniform growth of etch tunnels during the electrochemical etching of an aluminum foil.

DETAILED DESCRIPTION OF THE PREFERRED EMBODIMENT

The method of etching aluminum foil in accordance with the present invention increases the surface area of the foil by creating randomly distributed etch tunnels in the surface of the aluminum foil. The method is useful for etching aluminum foil for use in electrolytic capacitors, because the capacitance of an electrolytic capacitor increases with the surface area of the foil used as an electrode. By uniformly increasing the surface area of the electrode foil, the increase in capacitance is essentially consistent across the total surface area of the electrode foil.

The method of the present invention enhances the effectiveness of the electrochemical etching of an aluminum foil by utilizing one or more pretreatment steps. One embodiment of the present invention, by using only one pretreatment step, creates the etch tunnels without using the wet process of chemical etching. In the first pretreatment step, a discontinuous layer of metal that is cathodic to the aluminum foil is deposited on the surface of the foil, using any method known in the art, such as thermal or electron beam evaporation, sputtering, or chemical vapor deposition. The deposited metal should be cathodic to the aluminum foil in the electrolyte used, when subsequently electrochemically etching the foil. For example, metals that are cathodic to aluminum foil include lead, silver, gold, zinc, and tin.

The deposited layer of metal preferably should be a discontinuous layer in order to create a hererogenous surface comprising random areas of deposited metal, and random areas of bare aluminum. A preferred method to assure the creation of a discontinuous layer of metal is to deposit less metal than the minimum amount required to create one monolayer. One monolayer is a single molecular layer of deposited material. The minimum amounts of metal required for one monolayer of gold, silver, lead, zinc, or tin are approximately $15\times10^{15}$, $1.5\times10^{15}$, $1.0\times10^{15}$, $1.7\times10^{15}$, and $1.1\times10^{15}$ atoms/cm$^2$, respectively. The preferred amount of deposited metal is within the range between the minimum amount required to create about 0.01 monolayer, i.e., one-hundredth of the values above, and the minimum amount required to create about 1.0 monolayer, i.e., the values above. More preferably, the amount of deposited metal is within the range between the minimum amount required to create about 0.06 monolayer, and the minimum amount required to create about 0.5 monolayer. Additionally, current methods of thin-layer metal deposition create random clusters of deposited metal rather than a single molecular layer; therefore, a discontinuous layer can occur when depositing amounts of metal greater than the minimum amount required to create one monolayer. In accordance with another important embodiment of the present invention, the pattern of metal clusters deposited on the foil may be controlled by covering or masking portions of the aluminum foil prior to and during the metal deposition step.

A second pretreatment step may be employed to further improve the uniformity of the etch tunnel distribution obtained in the primary electrochemical etching step. The foil, having metal deposited on its surface, is pretreated by chemically etching the deposited metal using a relatively mild concentration of chemical etchant, such as hydrochloric, sulfuric, hydrofluoric, or fluosilicic acid. The concentration of the acid in the second pretreatment step should be below 3 Normal and preferably in the range of about 0.01 to about 1.0 Normal, more preferably about 0.01 to about 0.5 Normal. It is believed that this step removes portions of the aluminum adjacent to the deposited metal clusters, and that the resulting exposed aluminum surfaces become preferred sites for reaction during the final electrochemical etching step.

The final step in the method of the present invention is electrochemical etching of the pretreated aluminum foil, using any suitable electrochemical etching method known in the art. The metal clusters deposited in the first pretreatment step, and preferably the aluminum surfaces exposed by mild chemical etching in the second pretreatment step, act as local sites for cathodic reactions during the primary electrochemical etching step, and thus create etch tunnels adjacent to the deposited metal cluster sites. If the deposited metal layer is not discontinuous, or if the deposited metal clusters are not widely distributed, the primary electrochemical etch will produce only a small number of etch tunnels adjacent to the metal clusters, and the etch tunnels created will not be widely distributed.

The etch tunnels are more widely and randomly distributed across the surface of the aluminum foil, and are more uniform in size, when the foil is electrochemically etched using the pretreatment steps of depositing a metal layer cathodic to the aluminum foil and mildly chemically etching the foil having the deposited metal on its surface. After forming, i.e., treating to produce a dielectric oxide coating on the surface, the capacitance of the electrochemically etched foil is higher for a foil utilizing the pretreatment steps of the present invention.

The invention will be better understood from the following examples. The electrochemical etching bath contained one normal hydrochloric acid and seven normal sulfuric acid.

EXAMPLE 1

Gold was deposited on aluminum foil samples using a diode sputtering source in argon. The foil samples were then electrochemically etched using direct current for five seconds at a current density of 200 mA/cm$^2$. Oxide replicas were made using normal procedures known to one skilled in the art. A scanning electron microscope examination revealed an etch tunnel distribution more uniform than aluminum foil etched without the gold sputtering pretreatment. Further, the distribution of etch tunnels was shown to be influenced by the distribution of the deposited gold layer; a pretreatment step of sputtering gold through a mask controlled the pattern of subsequent etch tunnels, compared to an etch sample made by sputtering gold without a mask.

EXAMPLE 2

Gold was deposited to a thickness of about 0.4 monolayer, or about $6\times10^{14}$ atoms/cm$^2$, on aluminum foil using thermal evaporation from a tungsten boat in a vacuum chamber. The Rutherford Backscattering analysis method was used to determine the thickness of the deposited gold layer. The foil was then electrochemically etched using direct current for five seconds at a current density of 200 mA/cm$^2$. Scanning electron microscope examination revealed that the etch tunnels created in the pretreated foil were more uniformly distributed than the etch tunnels of a foil etched without the pretreatment step of depositing a discontinuous gold layer. The capacitance was 1.65 microfarad/cm$^2$ at 270 volts for the foil etched by using the pretreatment step of depositing a layer of gold, a value 26% higher than the capacitance for the foil etched without the pretreatment step. The mean density of the etch tunnels of the pretreated foil was $5.6\times10^6$ tunnels/cm$^2$, with a standard deviation for a $25\times25$ micron area of $2.2\times10^6$ tunnels/cm$^2$.

EXAMPLE 3

Submonolayers of gold, silver, tin, zinc, and lead were deposited on superpurity aluminum foil using vacuum evaporation from a heated tungsten filament or boat. A shutter above the source was opened or closed to start or stop the deposition of evaporated metal onto the target. A quartz crystal thickness monitor was used to measure the mass deposited. Table 1 shows the concentration level of the metal layer deposited on each sample.

TABLE 1

| SAMPLE | METAL | CONCENTRATION ($\times 10^{14}$ atoms/cm$^2$) |
|---|---|---|
| 1 | gold | 3 |
| 2 | gold | 8 |
| 3 | silver | 1 |
| 4 | silver | 3 |
| 5 | tin | 1 |
| 6 | zinc | 1 |
| 7 | lead | 1 |
| 8 | lead | 3 |

The samples were then chemically etched by a 0.036 molar aqueous solution of fluosilicic acid for 90 seconds at room temperature. The samples were then electrochemically etched using direct current for five seconds at a current density of 400 mA/cm$^2$. Scanning electron microscope examination showed that the electrochemically etched foils that were pretreated using the steps of metal deposition and chemical etch had more uniformly distributed etch tunnels than foils similarly electrochemically etched without the pretreatment steps.

EXAMPLE 4

Gold was deposited onto superpurity aluminum foil to a layer concentration of $3\times10^{14}$ atoms/cm$^2$ and $8\times10^{14}$ atoms/cm$^2$ using the method of Example 3. These two samples were not chemically etched, but were electrochemically etched using the method of Example 3. Scanning electron microscope examination showed more randomly distributed etch tunnel patterns than the etch tunnel distribution obtained after etching a foil without the gold metal deposition treatment.

What is claimed is:

1. A method of etching aluminum foil comprising the steps of depositing on the foil surface a discontinuous layer of metal that is cathodic to the foil in an electrolyte, and then electrochemically etching the foil in the electrolyte.

2. The method of claim 1, further including the step of chemically etching the foil containing the deposited metal layer prior to the electrochemical etching step.

3. The method of claim 2, wherein the chemical etchant comprises an acid.

4. The method of claim 3, wherein the acid is selected from the group consisting of hydrochloric, sulfuric, hydrofluoric, fluosilicic acids, and mixtures thereof.

5. The method of claim 1, wherein the electrochemical etching is anodic direct current electrochemical etching.

6. The method of claim 1, wherein the metal deposited on the metal foil surface is selected from the group consisting of gold, silver, lead, zinc, tin, and mixtures thereof.

7. The method of claim 6, wherein the amount of gold, silver, lead, zinc, or tin deposited is $0.9\times10^{14}$ to $8\times10^{14}$, $0.9\times10^{14}$ to $8\times10^{14}$, $0.6\times10^{14}$ to $5\times10^{14}$, $1\times10^{14}$ to $8.5\times10^{14}$, and $0.7\times10^{14}$ to $5.5\times10^{14}$ atoms/cm$^2$, respectively.

8. The method of claim 1, wherein the layer of metal is deposited by a dry process selected from the group consisting of thermal evaporation, electron beam evaporation, sputtering, and chemical vapor deposition.

9. The method of claim 8, further including the step of covering a portion of the metal foil surface prior to and during metal deposition.

10. An electrolytic capacitor electrode having its surface etched in accordance with the method of claim 1.

11. In an electrolytic capacitor of the type having two electrodes comprising an anode, and a cathode, and an electrolyte, wherein the improvement comprises at least one of said electrodes manufactured according to the method of claim 1.

12. A method of etching aluminum foil without using a chemical-etching wet process, comprising the steps of depositing on the foil surface a discontinuous layer of metal that is cathodic to the foil in an electrolyte, and then electrochemically etching the foil in the electrolyte.

13. The method of claim 12, wherein the electrochemical etching is anodic direct current electrochemical etching.

14. The method of claim 12, wherein the metal deposited on the metal foil surface is selected from the group consisting of gold, silver, lead, zinc, tin, and mixtures thereof.

15. The method of claim 14, wherein the amount of gold, silver, lead, zinc, or tin deposited is $0.9\times10^{14}$ to $8\times10^{14}$, $0.9\times10^{14}$ to $8\times10^{14}$, $0.6\times10^{14}$ to $5\times10^{14}$, $1\times10^{14}$ to $8.5\times10^{14}$, and $0.7\times10^{14}$ to $5.5\times10^{14}$ atoms/cm$^2$, respectively.

16. The method of claim 12, wherein the layer of metal is deposited by a dry process selected from the group consisting of thermal evaporation, electron beam evaporation, sputtering, and chemical vapor deposition.

17. The method of claim 16, further including the step of covering a portion of the metal foil surface prior to and during metal deposition.

18. An electrolytic capacitor electrode having its surface etched in accordance with the method of claim 12.

19. In an electrolytic capacitor of the type having two electrodes comprising an anode, and a cathode, and an electrolyte, wherein the improvement comprises at least one of said electrodes manufactured according to the method of claim 12.

20. In the electrolytic capacitor of claim 11, wherein said electrode is an anode.

21. In the electrolytic capacitor of claim 11, wherein said electrode is a cathode.

22. In the electrolytic capacitor of claim 11, wherein both the anode and the cathode are manufactured according to the method of claim 1.

23. In the electrolytic capacitor of claim 19, wherein said electrode is an anode.

24. In the electrolytic capacitor of claim 19, wherein said electrode is a cathode.

25. In the electrolytic capacitor of claim 19, wherein both the anode and the cathode are manufactured according to the method of claim 12.

* * * * *

UNITED STATES PATENT AND TRADEMARK OFFICE

CERTIFICATE OF CORRECTION

PATENT NO. : 5,405,493

DATED : APRIL 11, 1995

INVENTORS : DAVID GOAD

It is certified that error appears in the above-identified patent and that said Letters Patent is hereby corrected as shown below:

Column 4, line 24, delete "hererogenous" and substitute therefor -- heterogenous --;

and

Column 4, line 33, delete "$15 \times 10^{15}$" and substitute therefor -- $1.5 \times 10^{15}$ --.

Signed and Sealed this

Twelfth Day of September, 1995

*Attest:*

Bruce Lehman

BRUCE LEHMAN

*Attesting Officer*

*Commissioner of Patents and Trademarks*